US009484176B2

(12) United States Patent
Schenkel et al.

(10) Patent No.: US 9,484,176 B2
(45) Date of Patent: Nov. 1, 2016

(54) ADVANCED PENNING ION SOURCE

(71) Applicants: Thomas Schenkel, San Francisco, CA (US); Qing Ji, Albany, CA (US); Arun Persaud, El Cerrito, CA (US); Amy V. Sy, Berkeley, CA (US)

(72) Inventors: Thomas Schenkel, San Francisco, CA (US); Qing Ji, Albany, CA (US); Arun Persaud, El Cerrito, CA (US); Amy V. Sy, Berkeley, CA (US)

( * ) Notice: Subject to any disclaimer, the term of this patent is extended or adjusted under 35 U.S.C. 154(b) by 210 days.

(21) Appl. No.: 14/018,028

(22) Filed: Sep. 4, 2013

(65) Prior Publication Data

US 2014/0070701 A1 Mar. 13, 2014

Related U.S. Application Data

(60) Provisional application No. 61/698,999, filed on Sep. 10, 2012.

(51) Int. Cl.
*H01J 7/24* (2006.01)
*H01J 27/04* (2006.01)

(52) U.S. Cl.
CPC ..... *H01J 27/04* (2013.01)

(58) Field of Classification Search
None
See application file for complete search history.

(56) References Cited

U.S. PATENT DOCUMENTS 2,499,289 A * 2/1950 Backus ..... 250/426
2,967,257 A * 1/1961 Milleron ..... 417/49
2,993,638 A * 7/1961 Helmer et al. ..... 417/49
2,994,011 A * 7/1961 Belknap et al. ..... 331/131
3,051,868 A * 8/1962 Redhead ..... 315/108
3,070,719 A * 12/1962 Jepsen ..... 313/7
3,274,436 A * 9/1966 Reich ..... 315/111.91
3,280,365 A * 10/1966 Young ..... 315/111.91
3,580,052 A * 5/1971 Young ..... 73/40.7
3,835,319 A * 9/1974 Roehrig et al. ..... 250/292
3,955,118 A * 5/1976 Flemming ..... 315/111.81
4,166,018 A * 8/1979 Chapin ..... 204/192.12
4,303,865 A * 12/1981 Swingler ..... 250/423 R
5,075,594 A * 12/1991 Schumacher et al. ... 315/111.21
5,278,510 A * 1/1994 Baptist et al. ..... 324/460
5,311,028 A * 5/1994 Glavish ..... G21K 1/093 250/396 ML
5,502,354 A * 3/1996 Correa et al. ..... 315/111.01
5,610,477 A * 3/1997 Ivanov et al. ..... 313/573
6,184,624 B1 * 2/2001 Inouchi ..... H01J 27/18 118/723 MA
6,246,059 B1 * 6/2001 Maishev et al. ..... 250/426
6,351,131 B1 * 2/2002 Klepper et al. ..... 324/463
7,185,602 B2 * 3/2007 Horsky ..... C23C 14/48 118/723 HC
7,759,657 B2 * 7/2010 Tieger ..... H01L 21/26513 250/492.21
7,838,850 B2 * 11/2010 Hahto ..... H01J 27/205 250/492.1

(Continued)

OTHER PUBLICATIONS

A. Sy "Novel methods for improvement of a Penning ion source for neutron generator applications" Review of Scientific Instruments 83 02B309 (2012) available on line from Feb. 14, 2012.*

(Continued)

*Primary Examiner* — Douglas W Owens
*Assistant Examiner* — Srinivas Sathiraju
(74) *Attorney, Agent, or Firm* — Lawrence Berkeley National Laboratory

(57) ABSTRACT

This disclosure provides systems, methods, and apparatus for ion generation. In one aspect, an apparatus includes an anode, a first cathode, a second cathode, and a plurality of cusp magnets. The anode has a first open end and a second open end. The first cathode is associated with the first open end of the anode. The second cathode is associated with the second open end of the anode. The anode, the first cathode, and the second cathode define a chamber. The second cathode has an open region configured for the passage of ions from the chamber. Each cusp magnet of the plurality of cusp magnets is disposed along a length of the anode.

20 Claims, 7 Drawing Sheets

(56) References Cited

U.S. PATENT DOCUMENTS 8,071,958 B2 * 12/2011 Horsky ..... H01J 27/20 118/723 CB
8,110,820 B2 * 2/2012 Glavish ..... H01J 37/05 250/396 R
8,304,974 B2 * 11/2012 Watanabe et al. ..... 313/491
8,436,326 B2 * 5/2013 Glavish ..... H01J 37/05 250/281
2003/0234369 A1 * 12/2003 Glukhoy ..... 250/423 R
2004/0104683 A1 * 6/2004 Leung ..... H01J 27/18 315/111.81
2006/0019039 A1 * 1/2006 Hanawa ..... C23C 14/046 427/523
2008/0067411 A1 * 3/2008 Nishino et al. ..... 250/423 R
2008/0290266 A1 * 11/2008 Horsky ..... H01J 49/06 250/281
2009/0014667 A1 * 1/2009 Hahto ..... H01J 27/205 250/492.21
2009/0134018 A1 * 5/2009 Watanabe ..... 204/298.03
2009/0206270 A1 * 8/2009 Glayish ..... H01J 37/05 250/396 ML
2010/0025573 A1 * 2/2010 Hahto ..... H05H 3/06 250/251
2010/0066252 A1 * 3/2010 Reijonen ..... H05H 3/06 315/111.81
2010/0107980 A1 * 5/2010 Horsky ..... C23C 14/48 118/723 E
2010/0215136 A1 * 8/2010 Rusnak et al. ..... 376/108
2010/0259273 A1 * 10/2010 Kawasaki et al. ..... 324/460
2010/0320395 A1 * 12/2010 Hahto ..... H01J 27/205 250/426
2011/0044418 A1 * 2/2011 Stubbers et al. ..... 376/116
2011/0089321 A1 * 4/2011 Glavish ..... H01J 37/05 250/298
2011/0279127 A1 * 11/2011 Kawasaki et al. ..... 324/460
2012/0103837 A1 * 5/2012 Wall et al. ..... 205/793
2013/0256522 A1 * 10/2013 Perkins et al. ..... 250/259

OTHER PUBLICATIONS

T Zhang et al "Experimental study for 15-20 mA dc H- multicusp source" Review of scientific instruments 81 02A705(2010).*
J.J. Scholtz et al "Secondary electron emission properties" Phillips J Res (1996) 375-389.*
J.L. Rovey, B.P. Ruzic, and T.J. Houlahan, Rev. Sci. Instrum. 78, 106101 (2007).
B.K. Das and A. Shyam, Rev. Sci. Instrum. 79, 123305 (2008).
J.R.J. Bennett, IEEE Transactions on Nuclear Science, 19, 48 (1972).
K.N. Leung, T.K. Samec, and A. Lamm, Phys. Lett. 51A, 490 (1975).
A. Persaud, I. Allen, M.R. Dickinson, T. Schenkel, R. Kapadia, K. Takei and A. Javey, J. Vac. Sci. Technol. B 29 02B107 (2011).
A. Sy, Q. Ji, A. Persaud, O. Waldmann, and T. Schenkel, Rev. Sci. Instrum. 83, 02B309 (2012).

* cited by examiner

ADVANCED PENNING ION SOURCE

RELATED APPLICATIONS

This application claims priority to U.S. Provisional Patent Application No. 61/698,999, filed Sep. 10, 2012, which is herein incorporated by reference.

STATEMENT OF GOVERNMENT SUPPORT

This invention was made with government support under Contract No. DE-AC02-05 CH11231 awarded by the U.S. Department of Energy. The government has certain rights in this invention.

TECHNICAL FIELD

This disclosure relates generally to ion sources and more particularly to Penning ion sources.

BACKGROUND

Penning ion sources[1-3] can be used for neutron generation through deuterium-deuterium (D-D) or deuterium-tritium (D-T) fusion reactions, and offer the benefits of low power consumption, ease of operation, and compactness, in some configurations. Maximum neutron yields with Penning ion sources are limited by the poor atomic ion fraction characteristic of Penning discharges; typically over ninety-percent of extracted ions are molecular, necessitating high beam energy and current to obtain suitable neutron yields for imaging and interrogation purposes.

SUMMARY

One innovative aspect of the subject matter described in this disclosure can be implemented in an apparatus including an anode, a first cathode, a second cathode, and a plurality of cusp magnets. The anode has a first open end and a second open end. The first cathode is associated with the first open end of the anode. The second cathode is associated with the second open end of the anode. The anode, the first cathode, and the second cathode define a chamber. The second cathode defines an open region configured for the passage of ions from the chamber. Each cusp magnet of the plurality of cusp magnets is disposed along a length of the anode.

In some embodiments, the plurality of cusp magnets are configured to generate a multi-cusp magnetic field, with the multi-cusp magnetic field configured to contain a plasma generated in the chamber. In some embodiments, containment of the plasma reduces contact of the plasma with the anode.

In some embodiments, the plurality of cusp magnets includes about 8 to 14 cusp magnets. In some embodiments, each cusp magnet of the plurality of cusp magnets includes a neodymium magnet. In some embodiments, the plurality of cusp magnets is associated with an exterior surface of the anode. In some embodiments, a length of each cusp magnet of the plurality of cusp magnets is about a length of the anode. In some embodiments, the anode has a cylindrical cross section, with the anode defining a hollow cylindrical region with the first open end and the second open end.

In some embodiments, the anode, the first cathode, and the second cathode comprise a first metal, and surfaces of the anode, the first cathode, and the second cathode defining the chamber have a second metal disposed thereon. The second metal has a higher secondary electron emission coefficient compared to the first metal. In some embodiments, the first metal is selected from a group consisting of steel, copper, a copper alloy, aluminum, and an aluminum alloy. In some embodiments, the second metal is selected from a group consisting of gold and platinum. In some embodiments, the second metal comprises molybdenum.

In some embodiments, the apparatus further includes a field emitter array disposed on a surface of the first cathode defining the chamber. In one embodiments, the field emitter array includes carbon nanofiber arrays. In some embodiments, the field emitter array is configured to increase a plasma density of a plasma generated in the chamber. In some embodiments, the apparatus further includes a grid positioned proximate the field emitter array, with the grid is being configured to generate an electric field for electron emission from the field emitter array.

In some embodiments, a length of the anode is greater than a cross-sectional dimension of the anode. In some embodiments, the length of the anode is about 1.25 to 2 times greater than the cross-sectional dimension of the anode.

Another innovative aspect of the subject matter described in this disclosure can be implemented in an apparatus including an anode, a first cathode, a second cathode, and a plurality of cusp magnets. The anode has a first open end and a second open end. A length of the anode is greater than a cross-sectional dimension of the anode. A first cathode is associated with the first open end of the anode. A second cathode is associated with the second open end of the anode. The anode, the first cathode, and the second cathode define a chamber. The second cathode defines an open region configured for the passage of ions from the chamber. The anode, the first cathode, and the second cathode comprising a first metal, and surfaces of the anode, the first cathode, and the second cathode defining the chamber have a second metal disposed thereon. The second metal has a higher secondary electron emission coefficient compared to the first metal. Each cusp magnet of the plurality of cusp magnets is disposed along a length of the anode.

In some embodiments, the plurality of cusp magnets are configured to generate a multi-cusp magnetic field, with the multi-cusp magnetic field being configured to contain a plasma generated in the chamber.

Details of one or more embodiments of the subject matter described in this specification are set forth in the accompanying drawings and the description below. Other features, aspects, and advantages will become apparent from the description, the drawings, and the claims. Note that the relative dimensions of the following figures may not be drawn to scale.

DETAILED DESCRIPTION

Figure 1:
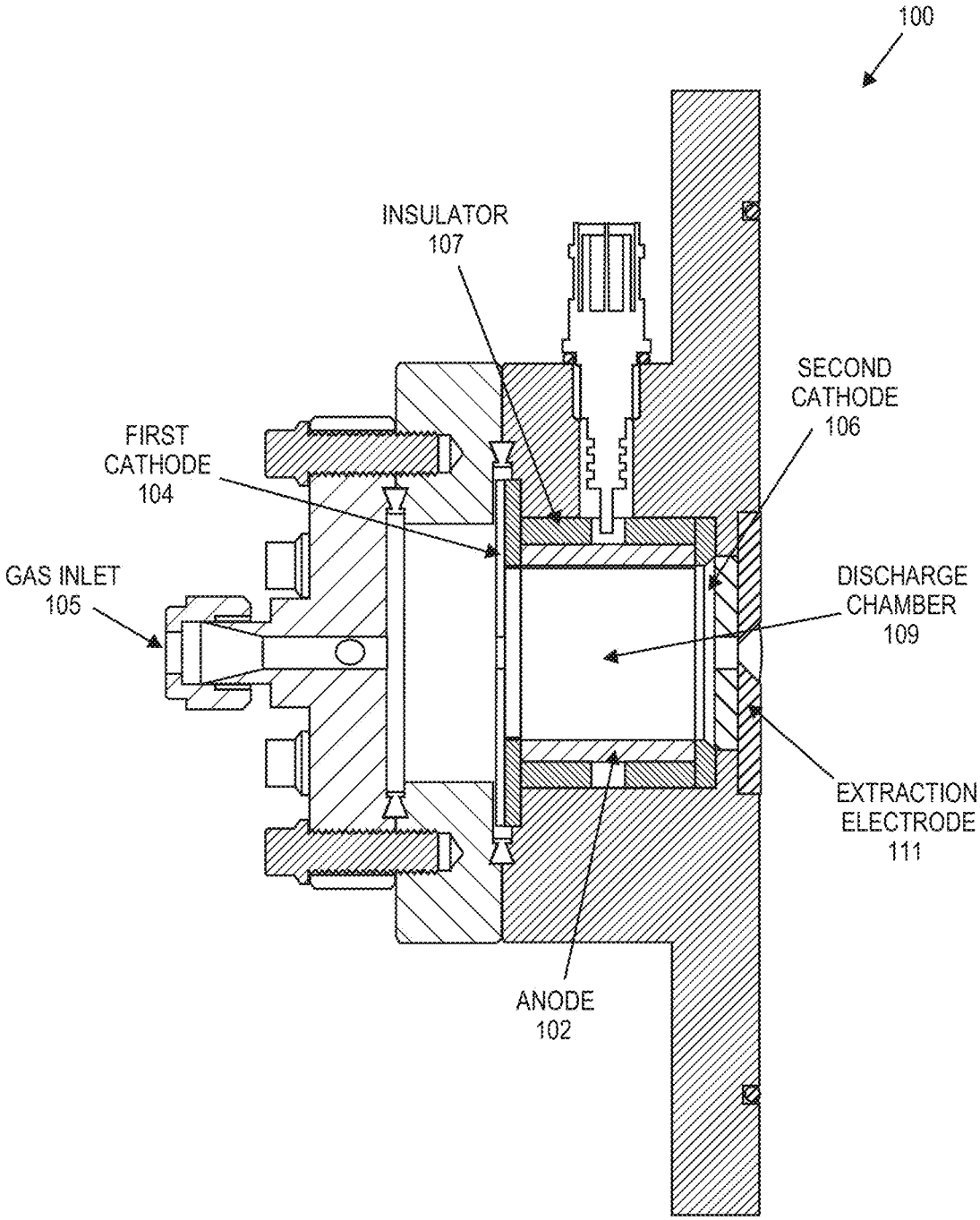
FIG. 1 shows an example of a cross-sectional schematic illustration of a Penning ion source.

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Various techniques and mechanisms of the present invention will sometimes be described in singular form for clarity. However, it should be noted that some embodiments include multiple iterations of a technique or multiple instantiations of a mechanism unless noted otherwise.

Introduction

For a hydrogen discharge using a Penning ion source, the generally poor proton fraction has been attributed to low electron density and short dwell time of molecular hydrogen ($H_2^+$) ions.[4] Deuterium discharges are expected to behave in a similar manner. Increased neutron yields can be directly expected from increased electron density in the discharge, as both atomic ion fraction and ion density should increase with increased electron density.

Penning ion sources can be improved to enhance the atomic ion fraction and ion beam current density while maintaining low power consumption. The neutron yield of a Penning ion source is proportional to the ion current; a tenfold increase in the ion current density results in a tenfold increase in the neutron yield. Increasing the atomic ion fraction will also increase the neutron yield. Ion currents in commercially available neutron generators are typically in the range of tens of microamperes (μA). Described herein are systems, methods, and apparatus that enable about 100 μA to 1 milliampere (mA) of extracted ion current while maintaining low power consumption.

Apparatus

An ion source is a device that is used to generate charged particles, i.e., ions. A Penning ion source is a cold cathode ion source which uses crossed electric and magnetic fields. A magnetic field, oriented parallel to an axis defined by the anode of the Penning ion source, may be produced using an external field coil or a permanent magnet. In operation, a plasma is generated along the axis of the Penning ion source. Electrons in the plasma ionize a gas (e.g., hydrogen, argon, etc.) in the Penning ion source. Ions may be extracted though one of the cathodes positioned on either end of the anode of the Penning ion source.

Described herein are enhancements to a Penning ion source which may increase the current density of extracted ions several-fold, with minimal increases in complexity and cost of the ion source, and without increasing the operating power of the ion source. Such modifications include, for example, gold, platinum, or molybdenum coated electrodes, a field emitter array for electron injection into the plasma, a radial multi-cusp field superimposed upon the conventional axial magnetic field, and an elongated anode geometry. These modifications may result in an up to eightfold increase in the extracted ion current. Further increases in the ion beam current density may be also possible.

FIG. 1 shows an example of a cross-sectional schematic illustration of a Penning ion source 100. As shown in FIG. 1, the Penning ion source 100 includes an anode 102, a first cathode 104, and a second cathode 106. The anode 102 has a first open end and a second open end. For example, in some embodiments, the anode 102 may have a cylindrical cross section, with the anode 102 defining a hollow cylindrical region with the first open end and the second open end; i.e., the anode 102 may comprise a tube. The first cathode 104 is associated with the first open end of the anode 102. The second cathode 106 is associated with the second open end of the anode 102. The anode 102, the first cathode 104, and the second cathode 106 define a chamber 109.

A gas inlet 105 allows for the introduction of a gas to the chamber 109 that is to be ionized in the Penning ion source 100. An insulator 107 is positioned to prevent contact between the anode 102, the first cathode 104, and the second cathode 106. A positive bias with respect to the cathodes 104 and 106 may be applied to the anode 102 to maintain a discharge. An extraction electrode 111 serves to extract ions from the chamber 109 of the Penning ion source 100.

While the anode 102 is shown in FIG. 1 as having a circular cross-section, the anode 102 may have other cross-sections. For example, in some embodiments, the anode 102 may have a rectangular, hexagonal, or an octagonal cross-section.

Figure 2:
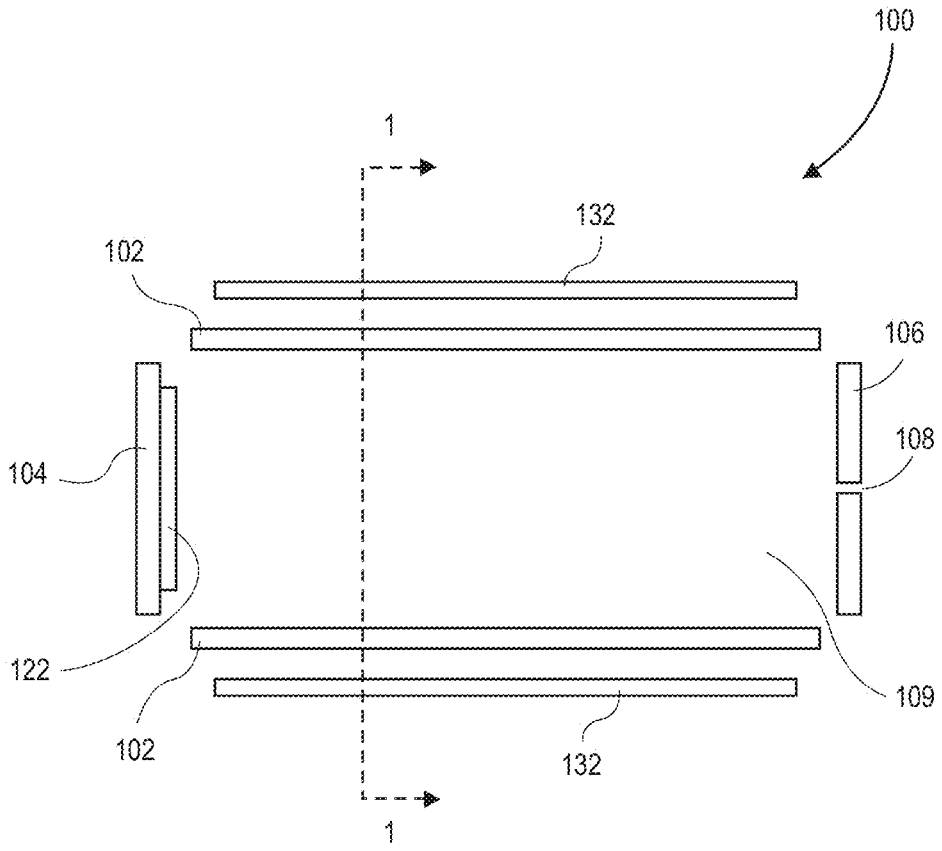
FIG. 2 shows an example of a cross-sectional schematic illustration of components of a Penning ion source.
Figure 3A:
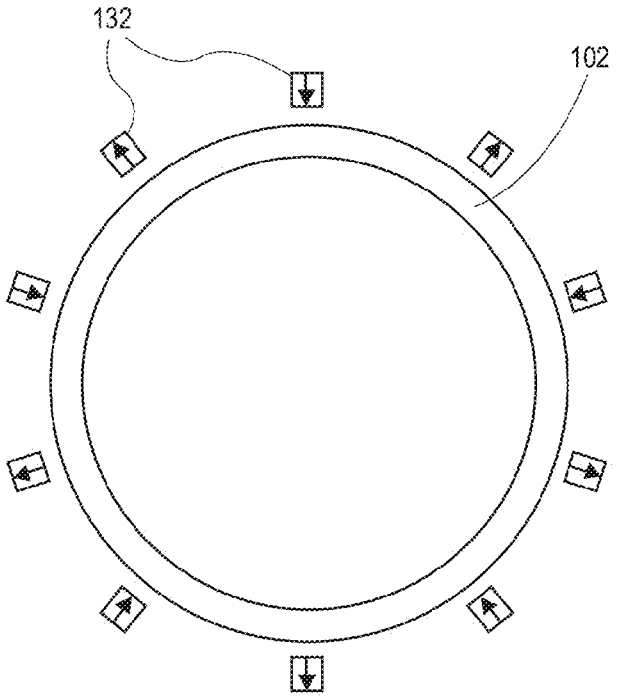
FIGS. 3A and 3B show examples of schematic illustrations of components of a Penning ion source though line 1-1 in FIG. 2.
Figure 3B:
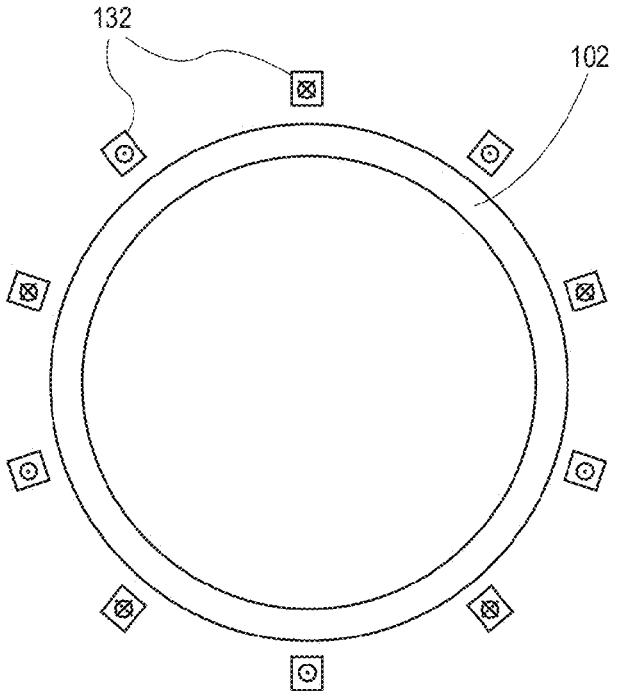

FIGS. 2, 3A, and 3B show examples of schematic illustrations of components of a Penning ion source. FIG. 2 shows an example of a cross-sectional schematic illustration of components of a Penning ion source, and FIGS. 3A and 3B show examples of a schematic illustrations of components of a Penning ion source though line 1-1 in FIG. 2.

As shown in FIG. 2, the Penning ion source 100 includes the anode 102, the first cathode 104, and the second cathode 106. The anode 102, the first cathode 104, and the second cathode 106 define a chamber 109. The first cathode 104 is associated with a first end of the anode 102, and the second cathode 106 is associated with a second end of the anode 102. The first and the second cathodes are not in contact with the anode 102, but are electrically insulated from the anode 102 with the insulator (not shown in FIG. 2). The second cathode 106 includes an open region 108 for the passage of ions from the Penning ion source 100.

In some embodiments, surfaces of the anode 102, the first cathode 104, and the second cathode 106 defining the chamber 109 and exposed to a plasma generated in the Penning ion source 100 may be coated with a metal having a higher secondary electron emission coefficient than the metal from which the electrodes are fabricated (i.e., the anode 102, the first cathode 104, and the second cathode 106). Secondary electron emission is a phenomenon where electrons, called secondary electrons, are emitted from a surface of a material when an incident particle (e.g., an ion) impacts the surface with sufficient energy. The metal may be deposited onto the electrodes using a standard deposition process, such as physical vapor deposition (e.g., sputtering) or chemical vapor deposition.

For example, in some embodiments, the anode 102, the first cathode 104, and the second cathode 106 may be fabricated from steel (e.g., a stainless steel), copper, a copper alloy, aluminum, or an aluminum alloy. In some embodiments, surfaces of the anode 102, the first cathode 104, and the second cathode 106 that define the chamber 109 and are exposed to a plasma may be coated with gold or platinum. In some embodiments, surfaces of the anode 102, the first cathode 104, and the second cathode 106 that define the chamber 109 and are exposed to a plasma may be coated a metal comprising molybdenum. Molybdenum may not provide the performance increases of the Penning ion source 100 that gold or platinum may provide, but it is less expensive than gold or platinum and it does improve the performance of the Penning ion source 100. In some embodiments, the metal disposed on the surfaces of the electrodes may be less that about 1 micron thick. Coating the electrodes with a metal having a high secondary electron emission coefficient may increase the density of hydrogen ions or other ion species extracted from the Penning ion source 100. Coating the electrodes with a metal having a high secondary electron emission coefficient may also yield a lower recombination rate for atomic hydrogen (to form diatomic hydrogen) or other atomic species, which may increase the atomic fraction.

In some embodiments, the first cathode 104 may include a field emitter array 122 disposed on a surface of the first cathode 104 that defines the chamber 109. When the field emitter array 122 is disposed on a surface of the first cathode 104, a grid (not shown) may be placed proximate the field emitter array 122. In operation, the grid may be used to generate an electric field so that the field emitter array 122 emits electrons. In some embodiments, the grid may be positioned up to about 1 millimeter from the field emitter array 122, or about 50 microns to 500 microns from the field emitter array 122. In some embodiments, the field strength between the field emitter array 122 and the grid may be about 1 volt/micron to 10 volts/micron. In some embodiments, the field emitter array 122 may include carbon nanofiber arrays or a micro-fabricated silicon emitter.

In some embodiments, including a field emitter array 122 disposed on a surface of the first cathode 104 may improve the emission of electrons by the first cathode 104 into a plasma generated by the Penning ion source 100. Improving the emission of electrons into the plasma increases the plasma density, which in turn increases the density of ions that may be extracted from the Penning ion source 100 without increasing the discharge power. Including the field emitter array 122 on a surface of the first cathode 104 may also enable discharge operation at low discharge biases, which increases the ion source/neutron generator lifetime due to reduced sputtering of the surfaces (i.e., the surfaces of the anode 102, the first cathode 104, and the second cathode 106) of the Penning ion source 100.

In some embodiments, a field emitter array may be positioned on another surface of the chamber 109. For example, in some embodiments, a field emitter array may be positioned on a surface of the anode 102 or on a surface of the second cathode 106. Placing the field emitter array on another surface of the chamber 109 and not on a surface of the first cathode 104 or the second cathode 106 may protect the field emitter array from ion impact.

In some embodiments, the Penning ion source 100 may include a plurality of cusp magnets 132. In some embodiments, each of the cusp magnets 132 may include a permanent magnet or an electromagnet. In some embodiments, the permanent magnets may comprise neodymium magnets, such as NdBFe magnets, for example. In some embodiments, the plurality of cusp magnets 132 may include about 8 to 14 magnets (e.g., about 8, 10, 12, or 14 magnets). Each of the cusp magnets 132 may extend along the exterior of the anode 102; for clarity, only two cusp magnets 132 are shown in FIG. 2. As shown in FIGS. 3A and 3B, which each show 10 cusp magnets 132, the cusp magnets may be spaced equidistantly along the outside perimeter of the anode 102. In some embodiments, a length of each of the cusp magnets may be about the same length as a length of the anode 102.

In some embodiments, the plurality of cusp magnets 132 is configured to generate a multi-cusp magnetic field, superimposed over the axial magnetic field of the Penning ion source 100. In some embodiments, the axial magnetic field may be generated using an external field coil or using permanent magnets that produce an axial magnetic field. In some embodiments, the axial magnetic field may be about 200 gauss (G) to 600 G, or about 400 G. In some embodiments, the multi-cusp magnetic field may be strongest near inner surfaces of the anode 102. In some embodiments, the multi-cusp magnetic field near inner surfaces of the anode 102 may be about 325 G to 925 G, or about 650 G.

The multi-cusp magnetic field may serve to contain a plasma generated in the chamber 109 of the Penning ion source 100. Containment of the plasma may reduce, minimize, or prevent contact of the plasma with the anode 102 and reduce electron losses at the surface of the anode 102, increasing the plasma density. This, in turn, may increase the ion beam current density of the Penning ion source 100. In some embodiments, the plurality of cusp magnets 132 may increase the ion beam current density by more than a factor of 2.

FIGS. 3A and 3B show examples of two different configurations of cusp magnets that may be implemented in the Penning ion source 100. The two configurations utilize permanent cusp magnets that differ in their directions of magnetization. The two configurations result in different magnetic field distributions within the chamber 109. The cusp magnet configuration shown in FIG. 3A utilizes cusp magnets that are magnetized along the cross-sectional width of each cusp magnet. The cusp magnet configuration shown in FIG. 3B utilizes cusp magnets that are magnetized along the axis of the anode 102. In each case, a multi-cusp field is generated by alternating the magnetic poles around the anode 102.

In some embodiments, the geometry of the anode 102 may be changed or modified to increase the ion beam current density. In some embodiments, a length of the anode 102 may be greater than an inner cross-sectional dimension of the anode 102. In some embodiments, the length of the anode 102 may be about 1.25 to 2 times greater than the inner cross-sectional dimension of the anode 102. For example, when the anode 102 is a tube having a circular cross-section, the length of the anode 102 may be about 1.25 to 2 times greater than the inner diameter of the anode 102. As another example, for a compact Penning ion source, the cross-sectional diameter of the anode may be about 1 inch, and the length of the anode may be about 1.25 inches to 2 inches, or about 1.2 inches. Such an anode may increase the path for electrons in the chamber and increase the ionization of a gas in the Penning ion source.

The Penning ion source 100 shown in FIGS. 1 and 2 may be operated in a similar manner as other Penning ion sources, as known by one having ordinary skill in the art. For example, a gas to be ionized may be introduced to the chamber 109 through the gas inlet 105. The anode 102, the first cathode 104, and the second cathode 106 may be biased to generate a plasma in the chamber 109. The extraction electrode 111 may be biased to extract cations or anions from the chamber 109 through the open region 108 defined by the second cathode 106. Other methods also may be used to extract ions from the chamber 109.

Experimental

The following examples are intended to be examples of the embodiments disclosed herein, and are not intended to be limiting.

For experiments to test different modifications to a Penning ion source, an experimental ion source was used. The outer diameter of the anode was about 2.54 centimeters (cm) and had a length of about 3.14 cm. The axial magnetic field characteristic of Penning ion sources was generated by an external field coil. This external coil was used for experimental purposes, and may be replaced by permanent magnets that form a solenoid-like field in field/production implementations of a Penning ion source. The modular nature of the experimental Penning ion source allowed for the effects of different modifications on proton fraction and ion beam current to be observed.

Several techniques were investigated to improve a Penning ion source, including different electrode wall materials, different electrode geometries, different multi-cusp magnetic confinement configurations, and electron injection with field emitter arrays.

Several materials were investigated for use as plasma-facing materials for enhanced ion source operation; the effects of molybdenum, gold, graphite, and platinum coatings on aluminum electrodes on discharge characteristics were observed. The effect of a boron nitride coating on the cathode was also observed; boron nitride has been shown to enhance the proton fraction in hydrogen ion sources due to its low hydrogen atom recombination coefficient.[5]

A good electrode material would have a high secondary electron emission coefficient under both ion and electron bombardment and would also inhibit recombination effects that may occur through plasma-wall interactions. Materials with low electron work functions are expected to produce stronger discharge characteristics. Material effects were observed using interchangeable electrodes of the materials studied. Baseline operation of the source was characterized using aluminum electrodes.

Several electrode configurations were implemented to observe the effects of electrode geometry on discharge characteristics. The original configuration featured smooth cathodes and an about 2.54 cm long anode. A longer aluminum anode, about 4.1 cm long, was implemented separately for comparison with the original configuration. The longer aluminum anode increased the discharge volume by a factor of about 1.6.

Figure 4:
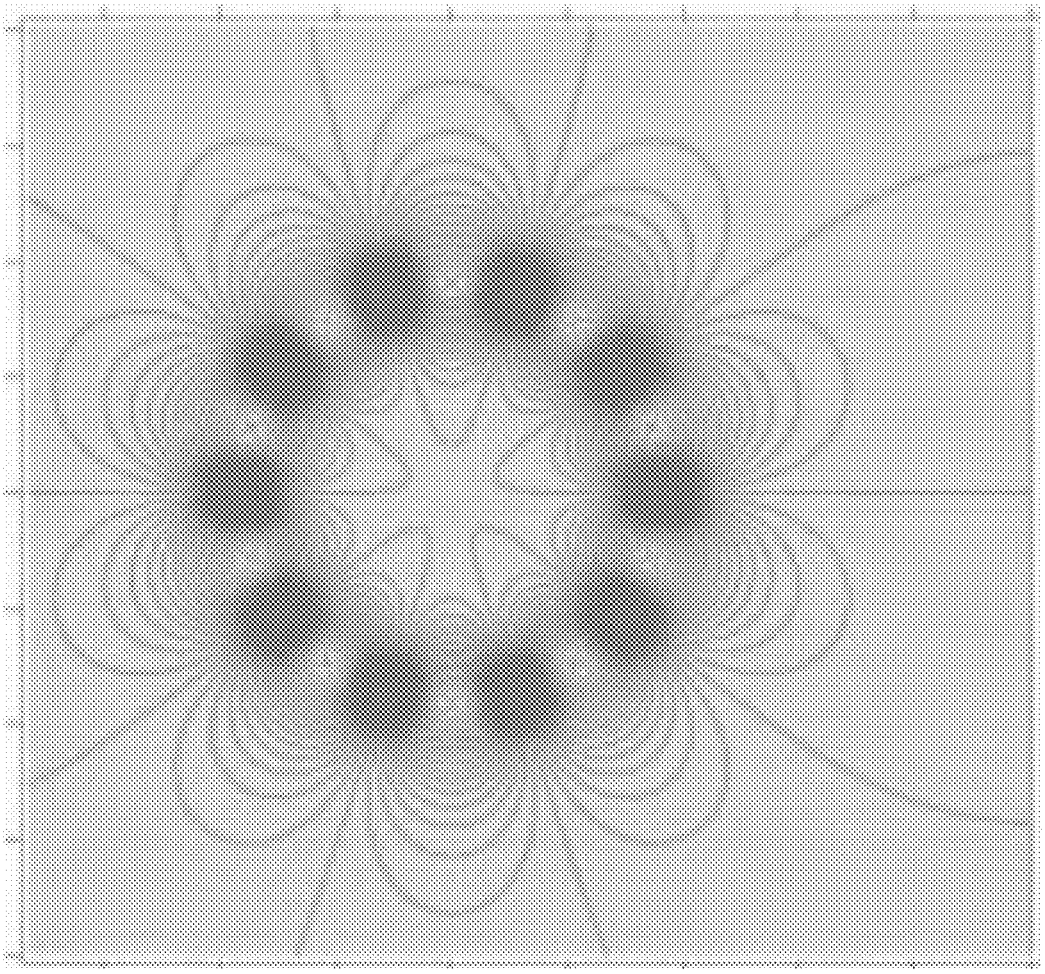
FIG. 4 shows a simulated multi-cusp magnetic field produced by a plurality of cusp magnets.

Multi-cusp magnetic fields improve the plasma density through improved confinement of primary ionizing electrons.[6] Multi-cusp magnetic field lines extend into the discharge region and reflect electrons back into the plasma, increasing the lifetime of ionizing electrons by reducing electron losses to the anode. The multi-cusp magnetic field for the Penning ion source was implemented with neodymium (e.g., NdFeB) permanent magnets; the multi-cusp magnets superimposed the resultant radial field distribution over the existing axial magnetic field. FIG. 4 shows a Pandira simulation of the radial magnetic field distribution. The simulated multi-cusp magnetic field is strongest near the inner wall of the anode, with a magnitude of 650 G. Multi-cusp magnetic confinement was implemented with aluminum, platinum, and gold electrodes, as well as with the longer aluminum anode.

Electrons to sustain the discharge in conventional Penning ion sources stem from secondary emission following ion impact on cathode surfaces. Carbon nanofiber arrays $_7$ were mounted on the downstream cathode surface (i.e., the first cathode) in the Penning ion source for electron injection along the axial direction; a grid placed between the discharge region and the field emitter arrays provided the field necessary for electron emission.

Figure 5:
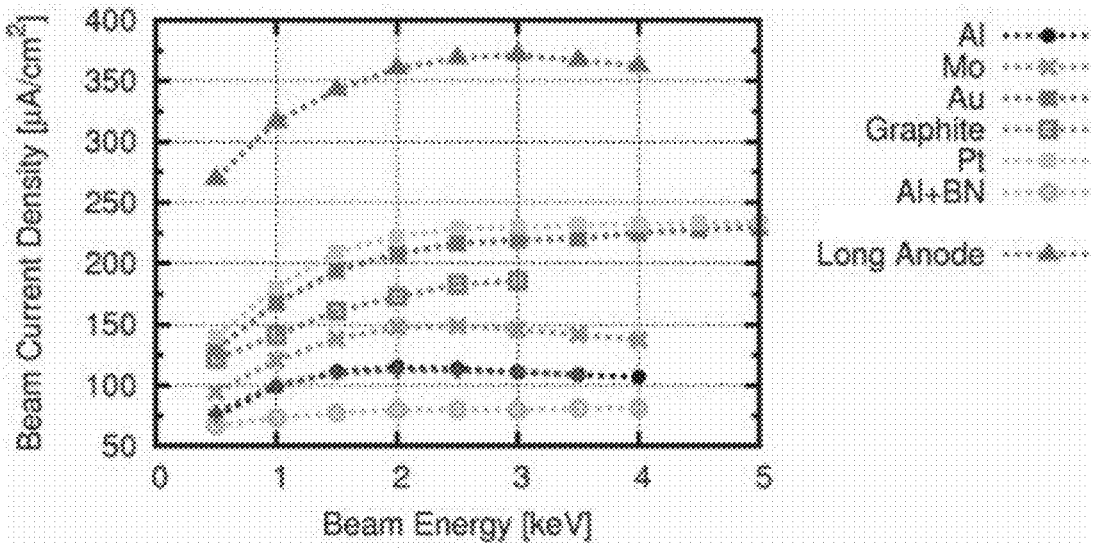
FIG. 5 shows the measured ion beam current density for various electrode coating materials and geometry configurations.

Table 1 lists the measured ion fractions obtained from hydrogen discharges during operation with various electrode materials; most discharges were ignited and maintained with 0.8 mTorr source pressure, 800 V applied anode voltage, and 410 G axial magnetic field. Stable operation with boron nitride required slightly higher pressure and discharge voltage. Typical proton fractions were in the range of 5-10%; the addition of boron nitride as a cathode coating resulted in a factor of two increase in the proton fraction when compared to baseline operation with aluminum. FIG. 5 shows the beam current density as a function of beam energy; beam current density values for beam energy of 3 keV are listed in Table 1. It is noted that the beam current density tends to decrease for beam energies greater than 3 keV due to use of an extraction system not optimized for this ion source. Most electrode coatings outperformed the baseline case of aluminum electrodes, likely the result of larger secondary electron emission coefficients; [8] operation with gold and platinum electrode coatings resulted in a factor of about two increase in beam current density. Operation with boron nitride coated cathodes resulted in a factor of three decrease in the beam current density.

TABLE I

| | $H^+$ [%] | $H_2^+$ [%] | $H_3^+$ [%] | Beam Current Density $\left[\frac{\mu A}{cm^2}\right]$ |
|---|---|---|---|---|
| Aluminum | 6.9 | 92.8 | 0.8 | 110.9 |
| Molybdenum | 6.3 | 93.3 | 0.4 | 145.9 |
| Gold | 7.7 | 91.3 | 1.0 | 219.2 |
| Graphite | 8.0 | 91.5 | 0.5 | 185.7 |
| Platinum | 8.9 | 90.1 | 1.0 | 229.4 |
| Aluminum with Boron Nitride | 16.2 | 80.4 | 3.4 | 79.5 |

Ion fractions and beam current density for discharges with various electrode materials. Beam current density for beam energy of 3 keV.

Operation with the long anode resulted in a factor of about three increase in the beam current density. Electrons in the discharge are confined to oscillate between the two cathodes; increasing the anode length increases the distance that electrons travel between the two cathodes, and more ionization can occur for a given pass through the discharge.

Figure 6:
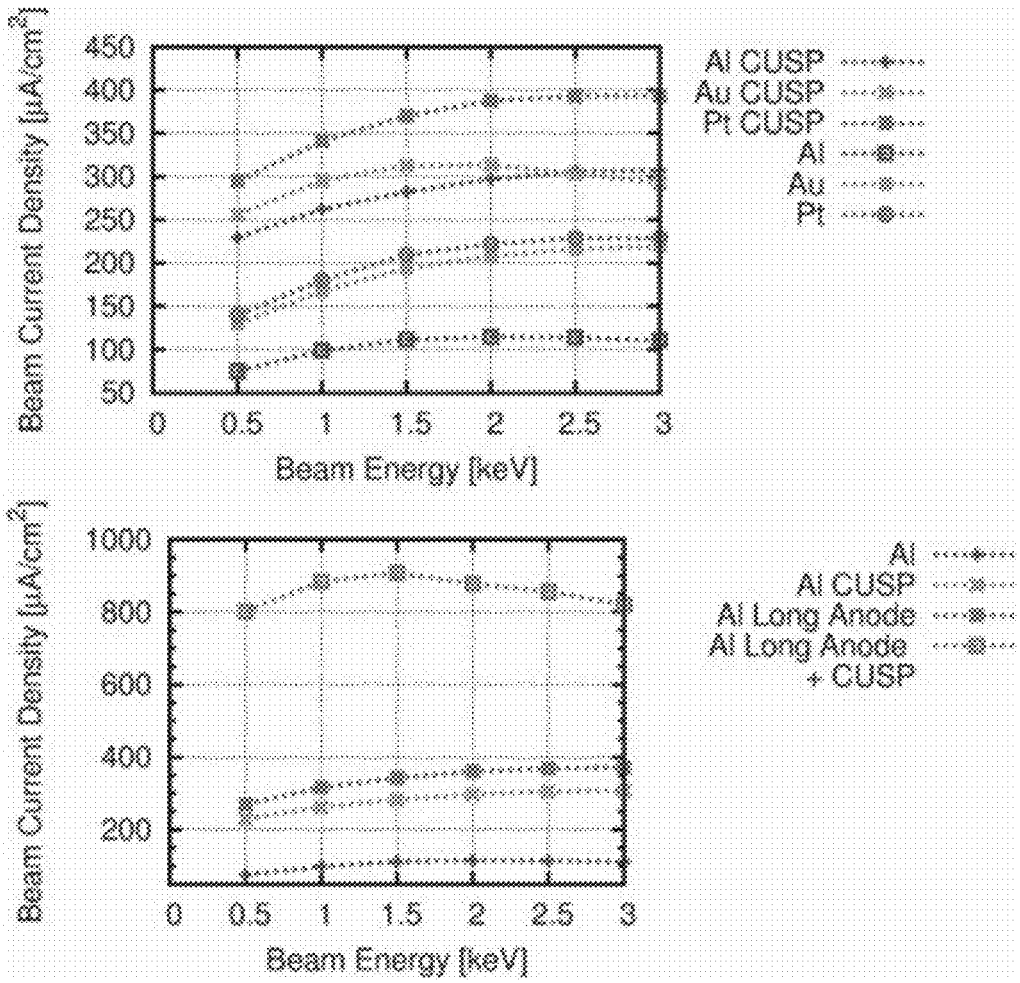
FIG. 6 shows the measured ion beam current density with and without multi-cusp magnetic confinement for different electrode coating materials.

The effect of multi-cusp magnetic confinement on the beam current density is shown in FIG. 6. For discharges with the original anode length, the extracted ion current increased by as much as a factor of about three with the additional magnetic confinement. Combining the long anode with multi-cusp magnets for aluminum electrodes resulted in an overall increase by a factor of about eight over the baseline case. It is anticipated that combining multi-cusp magnetic confinement with increased length of the discharge region may result in further improvement to the extracted ion current for discharges with gold and platinum coated electrodes.

Figure 7:
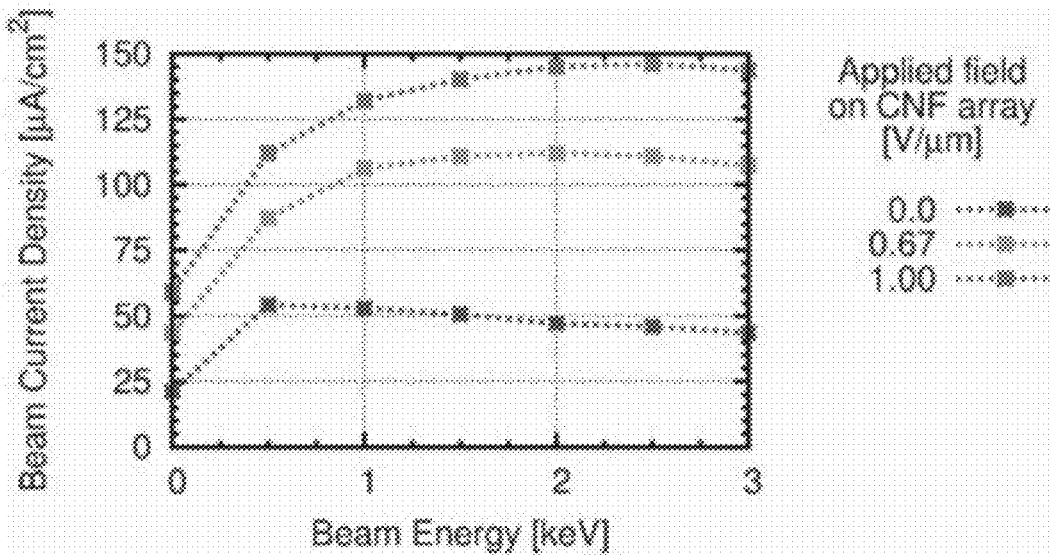
FIG. 7 shows the measured ion beam current density with and without a field electron array disposed on a cathode of the Penning ion source.

Electron current as a function of the electric field applied to the carbon nanofiber arrays was measured to characterize electron injection into the discharge. Electron currents of up to 30 μA were measured from the carbon nanofiber arrays when no plasma was present. Electrons were injected into the discharge with energies up to 300 eV. Discharge instabilities were observed when the injected electron current exceeded 1 μA. The effect of electron injection on the beam current density can be seen in FIG. 7. Increased injected electron current is accompanied by increased ion current density, but it is noted that other processes may be at play during operation with the field emitter arrays as the total discharge voltage increases with increasing emission.

CONCLUSION

In the foregoing specification, the invention has been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

Further details regarding the subject matter disclosed herein can be found in the publication A. Sy, Q. Ji, A. Persaud, O. Waldmann, and T. Schenkel, "Novel methods for improvement of a Penning ion source for neutron generator applications," REVIEW OF SCIENTIFIC INSTRUMENTS 83, 02B309 (2012), which is herein incorporated by reference.

References

Each of the following references, referred to above in the BACKGROUND section and in the DETAILED DESCRIPTION section, is herein incorporated by reference.

[1] J. L. Rovey, B. P. Ruzic, and T. J. Houlahan, Rev. Sci. Instrum. 78, 106101 (2007).

[2] B. K. Das and A. Shyam, Rev. Sci. Instrum. 79, 123305 (2008).

[3] J. R. J. Bennett, IEEE Transactions on Nuclear Science, 19, 48 (1972).

[4] F. K. Chen, J. Appl. Phys. 56, 3191 (1984).

[5] T. Taylor and J. S. C. Wills, Nucl. Instr. and Meth. A 309 (1991) p. 37.

[6] K. N. Leung, T. K. Samec, and A. Lamm, Phys. Lett. 51A, 490 (1975).

[7] A. Persaud, I. Allen, M. R. Dickinson, T. Schenkel, R. Kapadia, K. Takei and A. Javey, J. Vac. Sci. Technol. B 29 02B107 (2011).

[8] CRC Handbook of Chemistry and Physics, 91$^{st}$ ed, 2010-2011, pg. 12-115.

[9] J. Csikai, *CRC Handbook of Fast Neutron Generators Volume I*, CRC Press, 1987, p. 74.

What is claimed is:

1. An apparatus comprising:

an anode having a first open end and a second open end;

a first cathode associated with the first open end of the anode;

a second cathode associated with the second open end of the anode, the anode, the first cathode, and the second cathode defining a chamber, the second cathode defining an open region configured for the passage of ions from the chamber; and a plurality of cusp magnets, each cusp magnet of the plurality of cusp magnets being disposed along a length of the anode.

2. The apparatus of claim 1, wherein the plurality of cusp magnets are configured to generate a multi-cusp magnetic field, and wherein the multi-cusp magnetic field is configured to contain a plasma generated in the chamber.

3. The apparatus of claim 2, wherein containment of the plasma reduces contact of the plasma with the anode.

4. The apparatus of claim 1, wherein the plurality of cusp magnets includes about 8, 10, 12, or 14 cusp magnets.

5. The apparatus of claim 1, wherein each cusp magnet of the plurality of cusp magnets includes a neodymium magnet.

6. The apparatus of claim 1, wherein the plurality of cusp magnets is associated with an exterior surface of the anode.

7. The apparatus of claim 1, wherein a length of each cusp magnet of the plurality of cusp magnets is about a length of the anode.

8. The apparatus of claim 1, wherein the anode has a cylindrical cross section, and wherein the anode defines a hollow cylindrical region with the first open end and the second open end.

9. The apparatus of claim 1, wherein the anode, the first cathode, and the second cathode comprise a first metal, wherein surfaces of the anode, the first cathode, and the second cathode defining the chamber have a second metal disposed thereon, and wherein the second metal has a higher secondary electron emission coefficient compared to the first metal.

10. The apparatus of claim 9, wherein the first metal is selected from a group consisting of steel, copper, a copper alloy, aluminum, and an aluminum alloy.

11. The apparatus of claim 9, wherein the second metal is selected from a group consisting of gold and platinum.

12. The apparatus of claim 9, wherein the second metal comprises molybdenum.

13. The apparatus of claim 1, further comprising:

a field emitter array disposed on a surface of the first cathode defining the chamber.

14. The apparatus of claim 13, wherein the field emitter array includes carbon nanofiber arrays.

15. The apparatus of claim 13, wherein the field emitter array is configured to increase a plasma density of a plasma generated in the chamber.

16. The apparatus of claim 13, further comprising:

a grid positioned proximate the field emitter array, wherein the grid is configured to generate an electric field for electron emission from the field emitter array.

17. The apparatus of claim 1, wherein a length of the anode is greater than a cross-sectional dimension of the anode.

18. The apparatus of claim 17, wherein the length of the anode is about 1.25 to 2 times greater than the cross-sectional dimension of the anode.

19. An apparatus comprising:

an anode having a first open end and a second open end, a length of the anode being greater than a cross-sectional dimension of the anode;

a first cathode associated with the first open end of the anode;

a second cathode associated with the second open end of the anode, the anode, the first cathode, and the second cathode defining a chamber, the second cathode defining an open region configured for the passage of ions from the chamber, the anode, the first cathode, and the second cathode comprising a first metal, surfaces of the anode, the first cathode, and the second cathode defining the chamber having a second metal disposed thereon, the second metal having a higher secondary electron emission coefficient compared to the first metal; and a plurality of cusp magnets, each cusp magnet of the plurality of cusp magnets being disposed along a length of the anode.

20. The apparatus of claim 19, wherein the plurality of cusp magnets are configured to generate a multi-cusp magnetic field, and wherein the multi-cusp magnetic field is configured to contain a plasma generated in the chamber.

* * * * *